US006692220B2

(12) United States Patent
Plüss et al.

(10) Patent No.: US 6,692,220 B2
(45) Date of Patent: Feb. 17, 2004

(54) DEVICE FOR TRANSPORTING PRINTED PRODUCTS PLACED IN A STACK ON A SUPPORT

(75) Inventors: Thomas Albert Plüss, Zofingen (CH); Manfred Glauser, Olten (CH); Rudolf Kyburz, Zofingen (CH)

(73) Assignee: Müller Martini Holding AG, Hergiswil (CH)

( * ) Notice: Subject to any disclaimer, the term of this patent is extended or adjusted under 35 U.S.C. 154(b) by 0 days.

(21) Appl. No.: 10/179,362

(22) Filed: Jun. 25, 2002

(65) Prior Publication Data

US 2003/0007858 A1 Jan. 9, 2003

(30) Foreign Application Priority Data

Jul. 5, 2001 (EP) ..... 01810666

(51) Int. Cl.[7] ..... B65G 57/00

(52) U.S. Cl. ..... 414/790.3; 414/789; 414/789.1; 414/907

(58) Field of Search ..... 414/790.3, 788.9, 414/789, 789.1, 907

(56) References Cited

U.S. PATENT DOCUMENTS 4,068,567 A * 1/1978 Allison et al. ..... 414/790.3 X
4,457,656 A 7/1984 Kosina et al. ..... 414/788.3
4,708,561 A 11/1987 Merkli et al. ..... 414/790.3
4,720,229 A 1/1988 Steinhart ..... 414/790.3
5,282,716 A 2/1994 Prim et al. ..... 414/790.3
5,433,582 A 7/1995 Medina ..... 414/790.3
6,074,161 A * 6/2000 Gurtner ..... 414/790.3
6,409,462 B2 * 6/2002 Newsome et al. ... 414/790.3 X

* cited by examiner

*Primary Examiner*—Janice L. Krizek
(74) *Attorney, Agent, or Firm*—Friedrich Kueffner

(57) ABSTRACT

A device for transporting stacked printed products has a support on which the printed products are stacked to form a stack. A conveying device is arranged downstream of the support in a conveying-effecting manner. A reversible pushing device acts on a back side of the stack and transfers the stack from the support to the conveying device. The conveying device has a traction device and at least two deflecting rollers, wherein the traction device circulates about the at least two deflecting rollers and provides a conveying path for the stack. The conveying device has also a substantially horizontal guide table adjoining the traction device at both ends. At least an upstream end of the traction device in a conveying direction of the conveying path is positioned approximately at the level of the support. The traction device forms a conveying plane together with guide table.

13 Claims, 4 Drawing Sheets

Fig. 1
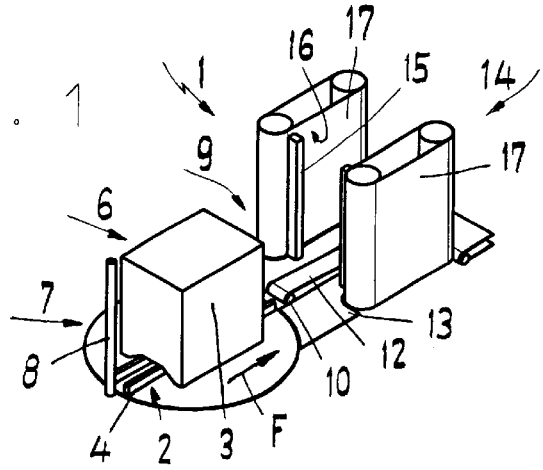
Fig. 2
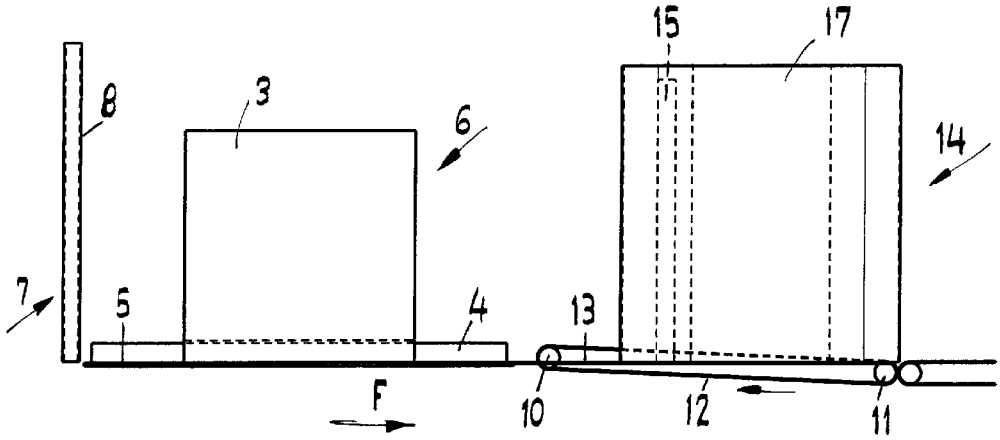
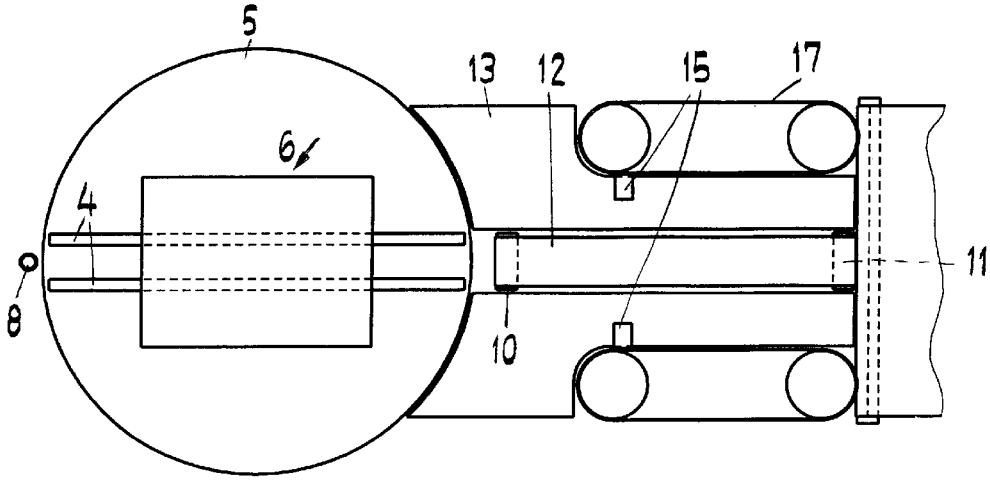
Fig. 3

Fig. 4
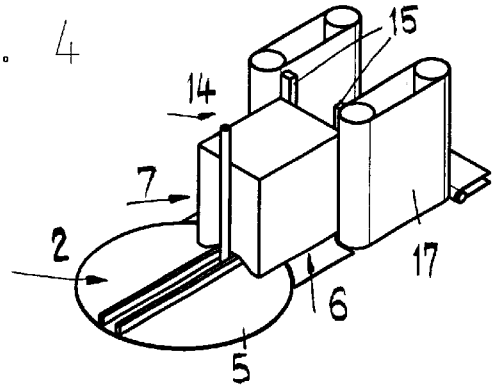
Fig. 5
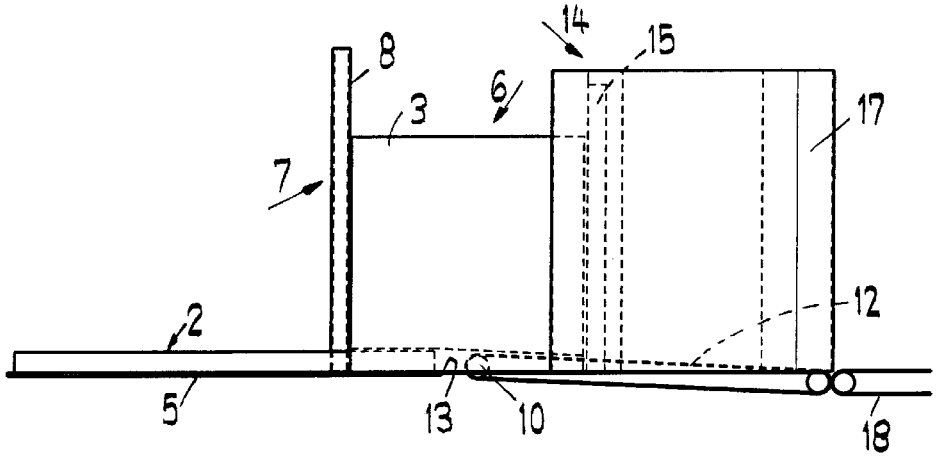
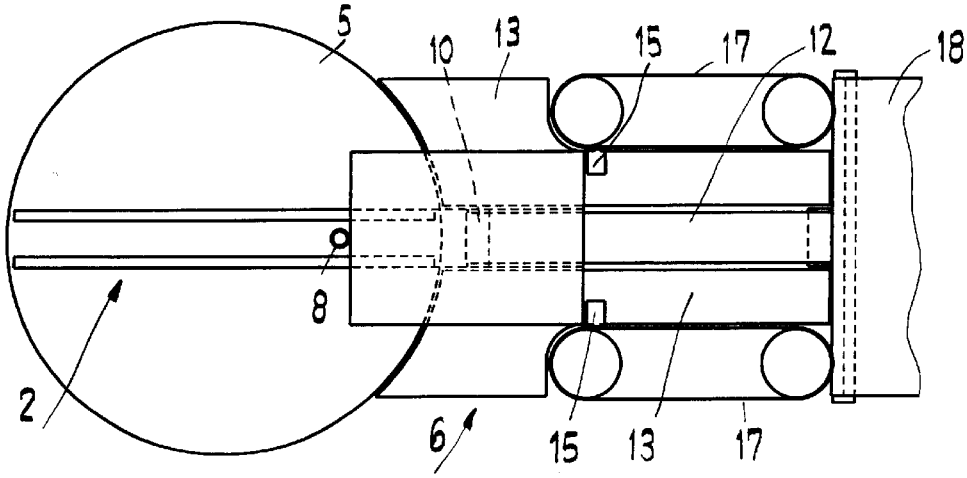
Fig. 6

Fig. 7
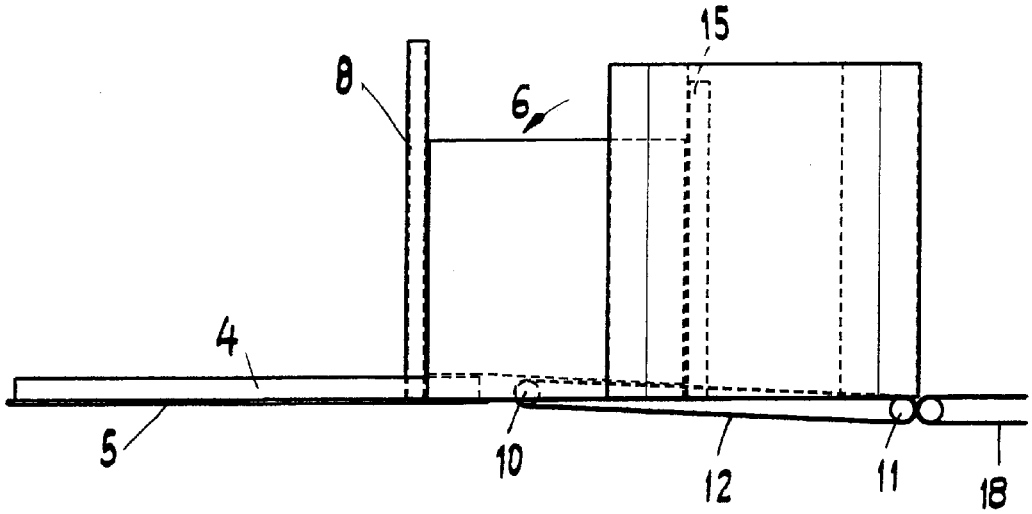
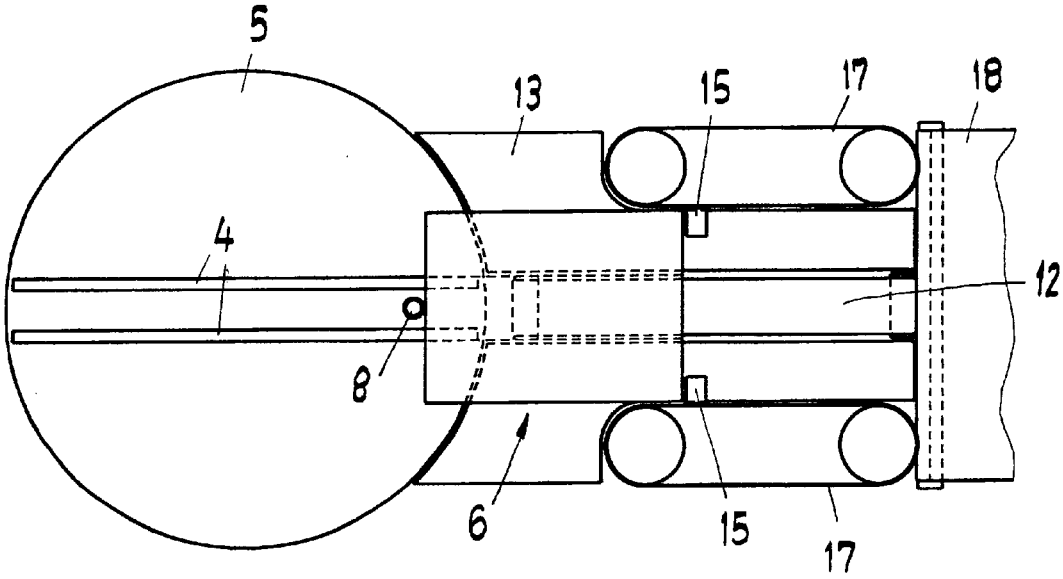
Fig. 8

Fig. 9
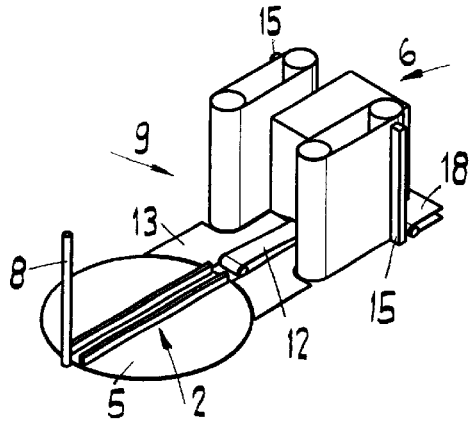
Fig. 10
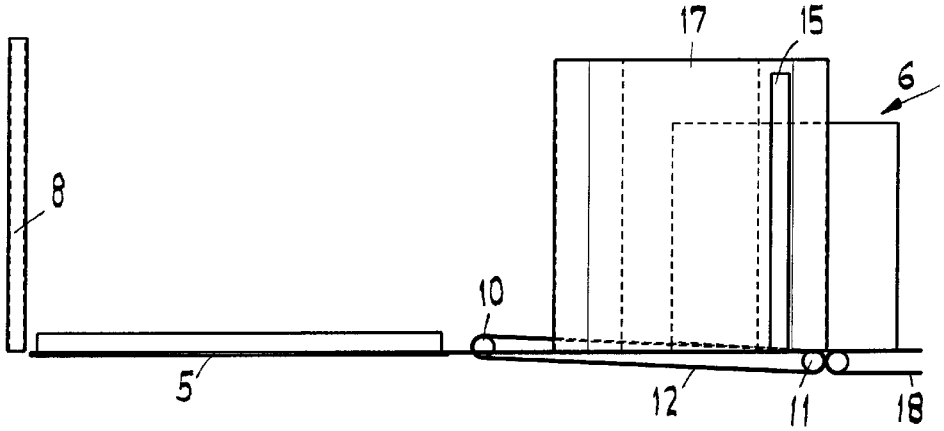
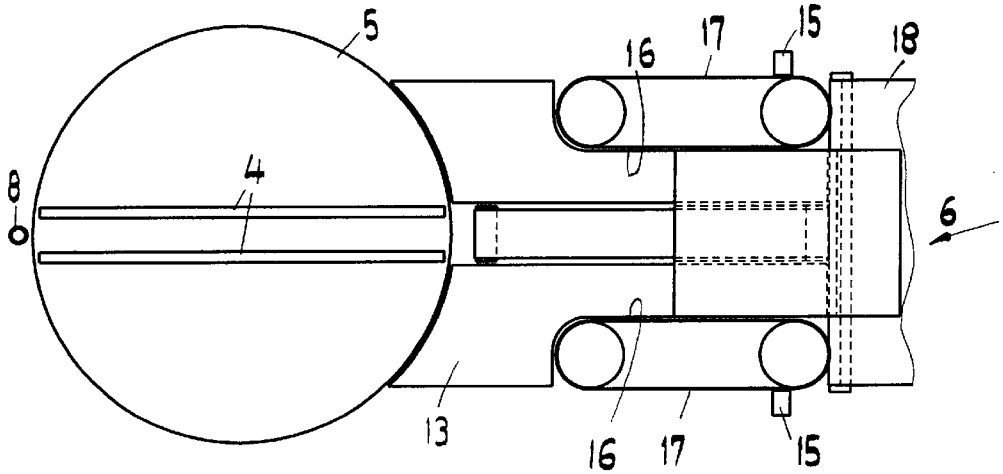
Fig. 11

DEVICE FOR TRANSPORTING PRINTED PRODUCTS PLACED IN A STACK ON A SUPPORT

BACKGROUND OF THE INVENTION

1. Field of the Invention

The invention relates to a device for transporting printed products placed in a stack onto a support and supplied to a conveying device, arranged downstream of the support in a conveying-effecting manner and comprising a traction means circulating about at least two deflecting rollers, by means of a reversible pushing device acting on the back side of the stack.

2. Description of the Related Art

Devices of this kind are employed inter alia for stacking printed products or finished printed products such as, for example, newspapers, magazines, brochures or the like, which are subsequently enveloped with a foil or tied with a string or with a strap.

In this connection, so-called stackers available from the company Müller Martini Marketing AG are known under the name "Forte", "Practico" or "Rapido".

The stacks, which are pushed out of the stacking area at high speed and are comprised of loosely stacked printed products, are subjected during their transport to the next processing station to various effects which can change the stack formation so that they can no longer be processed in a satisfactory or a sufficient way.

SUMMARY OF THE INVENTION

It is an object of the present invention to provide a device of the aforementioned kind with which the stack of printed products can be transported while maintaining the formation in a reliable way and at least approximately with constant format.

In accordance with the present invention, this is achieved in that the traction means at least at the upstream end is positioned approximately at the level of the support and forms a conveying plane together with a substantially horizontal guide table that adjoins on both ends. With this measure, a stack which is formed of loosely placed printed products can be transferred with uniform speed deceleration into a subsequent processing station so that the printed products do not experience displacement relative to one another. In this connection, the conveying plane can deviate from a planar surface, for example, it can be curved.

For beneficial effects in regard to the conveying action by the traction means, the guide table is positioned with a step relative to the support.

In order for the stack to remain substantially unchanged during transport, the conveying device is configured as a support device accompanying the leading or front end of the stack along the conveying path.

When the traction means has a conveying direction slanted toward the end of the conveying path, the conveying action can be further optimized.

For a universal use of the conveying device, it is favorable when the spacing between the pushing device and the support device can be adjusted depending on the format of the printed products.

For this purpose, the support device is advantageously driven in a cycle-synchronized fashion with the pushing device such that the stack during transfer to the conveying device is arranged between the pushing device and the support device so that a movement of the printed products within the stack can be prevented.

In this connection it is especially advantageous when the support device is formed by a vertical support strip acting onto the leading lateral edge of the stack, respectively.

For laterally guiding the stack in the conveying direction, the support strips are preferably fastened on at least one traction member forming lateral guide walls or guide sections and circulating about vertical axes.

For the adaptation to the format size of the printed products of the stack, the guide walls are arranged to be adjustable transversely to the conveying direction.

For changing the conveying action and conveying length of the conveying device, it is expedient when the slant of the conveying-effecting area of the traction means is adjustable about a horizontal axis extending transversely to the conveying direction of the stack.

An advantageous change of the conveying action can be obtained when the guide table is configured to be height-adjustable.

Preferably, the support is arranged on a table of a stacking device or a stacker and the printed products project in the conveying direction laterally past the support so that within the lower stack area they are slanted downwardly toward the table.

Expediently, the drive device of the conveying device is connected with a control device so that the conveying speed of the stack can be decelerated or controlled.

In the following, the invention will be described by means of one embodiment with the aid of the drawing, reference being had to the drawing with regard to all details not disclosed particularly in the description.

BRIEF DESCRIPTION OF THE DRAWING

In the drawing:

FIG. 1 is a schematic perspective illustration of the device according to the invention arranged downstream of a stacking device for printed products;

FIG. 2 is a side view of the device illustrated in FIG. 1;

FIG. 3 is a plan view onto the device according to FIG. 2;

FIG. 4 is a perspective illustration of the device during transport of a stack;

FIG. 5 is a side view of the situation illustrated in FIG. 4;

FIG. 6 is a plan view of the position of FIGS. 4 and 5;

FIG. 7 is a side view in the end position of the pushing device;

FIG. 8 is a plan view according to FIG. 7;

FIG. 9 is a perspective illustration of the device before leaving of the stack;

FIG. 10 is a side view of the position shown in FIG. 9; and

FIG. 11 is a plan view of the position of FIGS. 9 and 10.

DESCRIPTION OF THE PREFERRED EMBODIMENTS

FIGS. 1 through 10 show a device for transporting printed products 3, loosely placed in the form of the stack 6 onto a support 2. The support 2 is in the form of two parallel bars 4 which are fastened on the turntable 5 of a stacker which is not illustrated. This raised portion provided by the bars 4 in the central area of the stacking area enables a reliable pushing out of all printed products 3 forming the stack 6 from the turntable 5 of the stacker. The pushing device 7 according to the illustration is a vertical bar 8 which can be reciprocated between the bars 4 in the radial direction relative to the axis of the turntable 5. The support 2 has such a height that the bar 8 can engage the lowermost printed product 3 of the stack 6 and that the lowermost printed products 3 of the stack 6 are slanted toward the turntable 5.

In FIG. 1 a rest position is illustrated in which a finished stack 6 is ready for further processing, respectively, for transport away from the rotary table 5.

Downstream of the turntable 5 in the conveying direction F a conveying device 9 is positioned which comprises a traction means 12 circulating about two deflection rollers 10, 11 and a horizontal guide table 13 adjoining both sides. In the direction toward the end of the conveying path, the conveying-effective area of the traction means 12 is arranged at a slant, and the guide table 13 is arranged vertically stepped relative to the upstream end of the conveying path of the traction means 12 such that the conveying-active area of the traction means 12 ends at the level of the guide table 13 (see also FIG. 2); traction means 12 and guide table 13 form a conveying or guiding plane. Moreover, the conveying device 9 comprises a supporting device 14 which receives the leading side of the stack 6, viewed in the conveying direction, in a supporting way and which accompanies the stack 6 on a further section of the conveying path. This means that the stack 6, upon reaching the conveying device 9 or the traction means 12, is guided between the pushing device 7 and the support device 14. In this connection, a continuous stack transfer is realized by the pushing device 7 and supporting device 14 which are driven with approximately identical conveying speed.

In order to be able to transport different format sizes of the printed products 3 in the form of the stacks 6, the spacing between the pushing device 7 and the support device 14 is adjustable.

The support device 14 is comprised of two vertical support bars 15 acting on a leading lateral edge of the stack 6, respectively, and fastened on guide walls 16 circulating about vertical axes wherein the guide walls 16 are comprised of one or several endless belts 17 or traction members.

The spacing between two guide walls 16 can be adjusted in order to accommodate different format sizes. FIG. 2 illustrates the device 1 with respect to arrangement and configuration in the initial position in a top view.

In FIG. 4, the stack 6 is moved by the pushing device 7 on the support 2 and is partially within the effective range of the conveying device 9. In this connection, the stack 6 is secured at its leading side by the two oppositely positioned support bars 15 in an upright position with a constant format, wherein the pushing device 7 as well as the support device 14 have the same conveying speed.

In FIG. 5, the situation of FIG. 4 is illustrated in a side view, and this illustration shows that the lower area of the stack 6 which has partially left the support 2 rests also on the traction means 12 of the conveying device 9 and is arranged between the bar 8 of the pushing device 7 and the support bars 15 of the support device 14. FIG. 5 also illustrates the continuous transition at the conveying end of the support 2 and the receiving end of the traction means 12 as well as its slightly slanted arrangement of the traction means 12 relative to the guide table 13, the guide table 13 ending at the end of the traction means 12. When the slant is steeper, the conveying run of the traction means 12 and the guide table 13 will intercept one another earlier along the conveying path, i.e., the printed product will contact the guide table 13 earlier. FIG. 5 shows that the printed product area still resting on the support 2 is slanted more strongly to the side than in the leading area where between the traction means 12 and the guide table 13 a smaller spacing is present.

FIG. 6 illustrates the situation of FIG. 5 in a plan view; the stack 6 has just been gripped at the leading side by the support bars 15, i.e., the support bars 15 fastened on the circulating belt 17 enter the conveying path of the stack 6 so that they can provide a supporting action at the leading side. For this purpose, the support bars 15, or the support device 14, and the bar 8 of the pushing device 7 are synchronized with one another by means of a control device (not illustrated), i.e., they are adjustable according to the format. In the conveying direction F behind the conveying device 9 a transport belt 18 adjoins for transporting the stacks 6 farther.

The provided control device ensures not only the cycled transport between the pushing device 7 and the support device 14, it is also configured to provide a smooth transfer of the stacks 6 from the pushing device 7 to the support device 14 in that the stack 6, at the time of or before reaching the conveying device 9, can be braked or decelerated with regard to its conveying speed, preferably in a continuous fashion. The transport belt 18 is expediently controlled with the speed of the conveying device 9.

In FIGS. 7 and 8 the stacks 6 of printed products 3 is within the effective area of the conveying device 9. The bar 8 has thus reached its end position, and the conveying device 9 takes over lateral guiding and further transport.

According to FIG. 9 through 11 the pushing device 7 is in the initial position and the stack 6 is further transported exclusively by the traction means 12 and the lateral guide walls 16 until it has left the conveying device 9.

While specific embodiments of the invention have been shown and described in detail to illustrate the inventive principles, it will be understood that the invention may be embodied otherwise without departing from such principles.

What is claimed is:

1. A device for transporting printed products placed in a stack, the device comprising:

a support on which printed products are stacked to form a stack;

a conveying device, arranged downstream of the support in a conveying-effecting manner;

a reversible pushing device acting on a back side of the stack and configured to transfer the stack from the support to the conveying device;

the conveying device comprising a traction means and at least two deflecting rollers, wherein the traction means circulates about the at least two deflecting rollers and provides a conveying path for the stack;

wherein at least an upstream end of the traction means in a conveying direction of the conveying path is positioned approximately at the level of the support and wherein the traction means forms a substantially horizontal conveying plane together with a guide table, wherein the traction means is slanted in the conveying direction toward an end of the conveying path.

2. The device according to claim 1, wherein the guide table is vertically downwardly offset relative to the support.

3. The device according to claim 1, wherein the traction means has a slant in the conveying direction toward an end of the conveying path, wherein the slant is adjustable about a horizontal axis extending transversely to the conveying direction of the stack.

4. The device according to claim 1, wherein the guide table is height-adjustable.

5. The device according to claim 1, wherein the support is arranged on a table of a stacking device and the printed products of the stack project laterally past the support relative to the conveying direction.

6. The device according to claim 1, wherein the conveying device has a drive device provided with a control device for controlling a conveying speed of the conveying device.

7. The device according to claim 1, wherein the conveying device further comprises a support device accompanying a leading side of the stack on the conveying path.

8. The device according to claim 7, wherein the pushing device and the supporting device together are speed-controlled.

9. The device according to claim 7, wherein a spacing between the pushing device and the support device is adjustable depending on a size of the printed products.

10. The device according to claim 7, wherein the support device and the pushing device are driven in synchronization such that the stack during transfer to the conveying device is positioned between the pushing device and the support device.

11. The device according to claim 10, wherein the support device comprises support bars acting on a leading lateral edge of the stack, respectively.

12. The device according to claim 11, wherein the support device further comprises two traction members circulating about vertical axes and forming lateral guide walls, wherein the support bars are connected to the lateral guide walls.

13. The device according to claim 12, wherein the guide walls are adjustable transverse to the conveying direction of the stack.

* * * * *